US005558355A

United States Patent [19]

Henry

[11] Patent Number: 5,558,355

[45] Date of Patent: Sep. 24, 1996

[54] SNOWSPORT BINDINGS

[76] Inventor: Howarth P. Henry, 1760 Pomona Ave. #65, Costa Mesa, Calif. 92627

[21] Appl. No.: 213,467

[22] Filed: Mar. 14, 1994

Related U.S. Application Data

[63] Continuation of Ser. No. 951,233, Sep. 25, 1992, abandoned.

[51] Int. Cl.[6] ..... A63C 9/10; B62B 13/00

[52] U.S. Cl. ..... 280/624; 280/14.2

[58] Field of Search ..... 280/14.2, 607, 280/624, 615, 625, 631, 632; 36/117, 118, 119, 120, 121, 50.5, 607, 89, 115, 125

[56] References Cited

U.S. PATENT DOCUMENTS

| | | | |
|---|---|---|---|
| 3,887,205 | 6/1975 | Edmund | 280/624 |
| 4,019,267 | 4/1977 | Sadler | 36/120 |
| 4,219,216 | 8/1980 | Settembre | 280/615 |
| 4,395,055 | 7/1983 | Spademan | 280/624 |
| 5,143,396 | 9/1992 | Shaanan et al. | 280/607 |
| 5,190,310 | 3/1993 | Hauglin et al. | 280/607 X |

FOREIGN PATENT DOCUMENTS

| | | | |
|---|---|---|---|
| 0050607 | 4/1982 | European Pat. Off. | 36/120 |

*Primary Examiner*—BethAnne C. Dayoan
*Attorney, Agent, or Firm*—Loeb & Loeb

[57] ABSTRACT

A binding, which is particularly suitable for snowboarding, provides an easy to use kick-in boot engagement feature and a number of convenient ways to disengage the boot in a relatively small, light weight and economical structure. The binding has a pair of movable arms pivotally connected to a base. The base is securable to, for example, the top surface of a snowboard. The arms cooperate with a portion of the base to form pin receptacles adapted to receive pin ends extending from the user's boot. The arms are pivotal to selectively open and close the pin receptacles. A boot according to an embodiment of the invention includes a hollow hinge, with a hollow opening of sufficient diameter to accept the protrusions of the ankle bones. This larger hinge area distributes the stress in the boot material around the hinge. A device for selectively restricting the amount of allowed ankle movement is provided on the boot in the form of a telescoping cylinder damping structure mounted to the front of the boot.

9 Claims, 5 Drawing Sheets

SNOWSPORT BINDINGS

This is a continuation of application Ser. No.07/951,233 filed on Sep. 25, 1992, now abandoned.

BACKGROUND OF THE INVENTION

1. Field of the Invention

The present invention relates to boots and bindings for snowsports, such as snowboarding.

2. Related Art

With the increase in popularity of snowsports, such as snow-skiing and snow-boarding, the demand for better, more comfortable and higher performance snowsports equipment has also increased. This demand is especially felt among the snowboard enthusiasts, as snowboarding has only recently been introduced at most popular ski areas and has recently seen a surge in popularity without much development in equipment design. The boards have seen a few small changes, but the bindings and the boots are generally the same as they were upon introduction of the sport, and resemble the very earliest efforts of pioneer nordic skiers hundreds of years ago. The boots are similar to the after ski boots currently on the market, but stiffer and are tightened about a wearer's foot and lower leg by laces. The bindings are typically very heavy, bulky, plastic shells of frames fixed to the snowboard, with straps and buckles borrowed from some older designs of ski boots.

This type of existing equipment can be extremely inconvenient and hazardous. For example, to ride up in a chairlift, or even move in a lift line, one foot has to be released from the board to propel the user, like a scooter or skateboard. The snowboarder must undo two straps, and then sit down in the snow at the top of the lift on every run to struggle to do them up again.

Most modern ski boots have a high cuff around the ankle and lower part of the leg hinged to a lower foot casing, making them look as though they allow front to back movement of the lower leg. However, the hinges are solid structures, typically located below and behind the wearer's human ankle pivot point, such that the boot and the wearer's leg turn about different centers. As a result, the actual allowed ankle movement is severely limited, and sometimes reduced to zero.

SUMMARY OF THE INVENTION

A binding according to an embodiment of the invention is particularly suitable for snowboarding, in that it provides an easy to use kick-in boot engagement feature and a number of convenient ways to disengage the boot in a relatively small, light-weight and economical structure. The binding has a pair of movable arms pivotally connected to a base. The base is secured to, for example, the top surface of a snowboard. The arms cooperate with a portion of the base to form pin receptacles adapted to receive pin ends extending from the user's boot. The arms are pivotal to selectively open and close the pin receptacles.

A boot according to an embodiment of the invention includes a hollow hinge, with a hollow opening of sufficient diameter to accept the protrusions of the ankle bones. This larger hinge area distributes the stress in the boot material around the hinge and may make local reinforcement unnecessary. Since the hollow opening of the hinges accept the wearer's ankle bones, the hinges are located so as to have an axis of rotation in common with, or very close to, the axis of rotation of the wearer's ankle, without substantially increasing the boot width at the ankle.

The common, or near common, axis of rotation of the hinge and the wearer's ankle allows the cuff of the boot to move relative to the foot casing portion of the boot so as to resemble the relative movement of the wearer's foot and leg above the ankle. This allows the wearer to freely rotate the ankle and walk comfortably. However, since such free movement of the ankle may be unsatisfactory for certain snowsports activities, a device for selectively restricting the amount of allowed ankle movement is provided on the boot. This device, according to an embodiment of the invention, comprises a telescoping cylinder structure mounted at about 45 degrees to the front of the boot, the upper end near the top of the cuff, and lower end just above the foot.

The cylinder structure has two concentric telescoping piston rods. The outer rod carries a piston head having rubber bushings of different hardnesses both above and below it, so that the piston's movement can be controlled.

The inner piston rod is slidable within the outer rod, but is normally locked to the outer piston rod for downhill skiing. However, to make walking easy, a knob may be used to manually release the inner piston rod to allow free sliding movement of the inner piston rod within the outer rod for the ankle movement needed for walking comfortably.

For the beginner, shorter or less bushings above the piston head end allows a more upright stance, and softer bushings may be used below the piston head end. The more experienced, stronger skier would fit longer or more bushings above the piston head end and shorter or fewer bushings below the piston head end for greater forward lean of the legs.

DETAILED DESCRIPTION OF THE PREFERRED EMBODIMENTS

Figure 1:
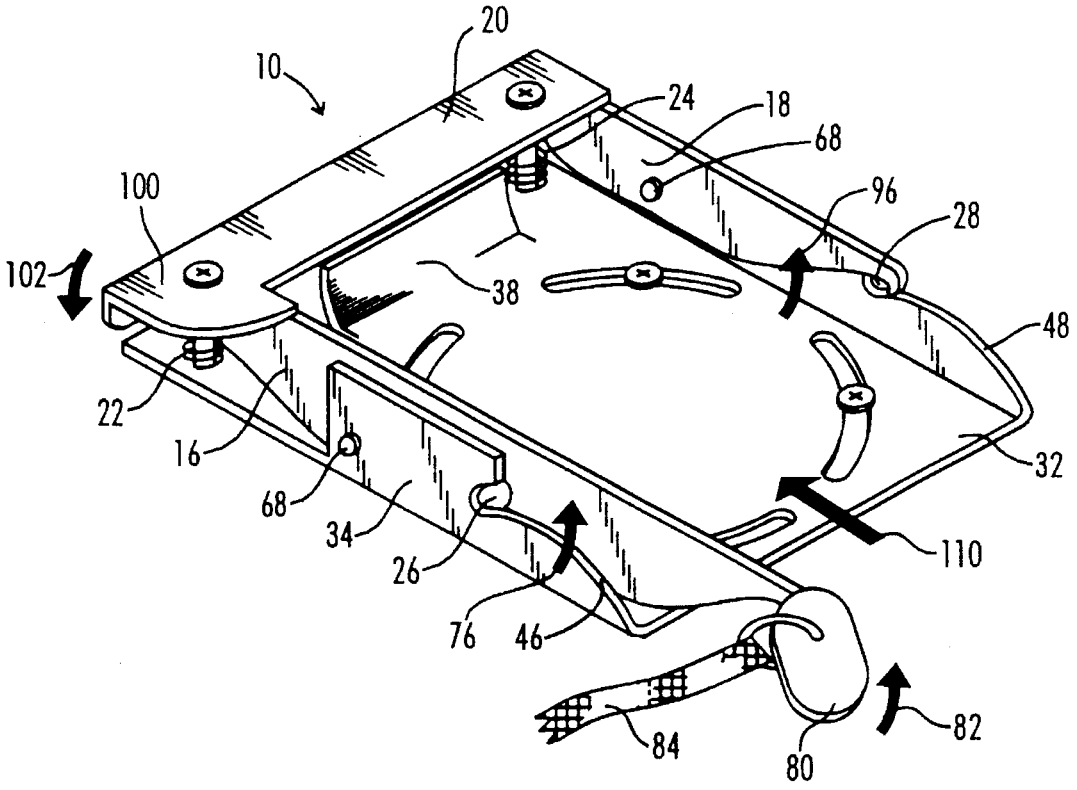
FIG. 1 is a perspective view of a binding according to an embodiment of the invention.
Figure 2:
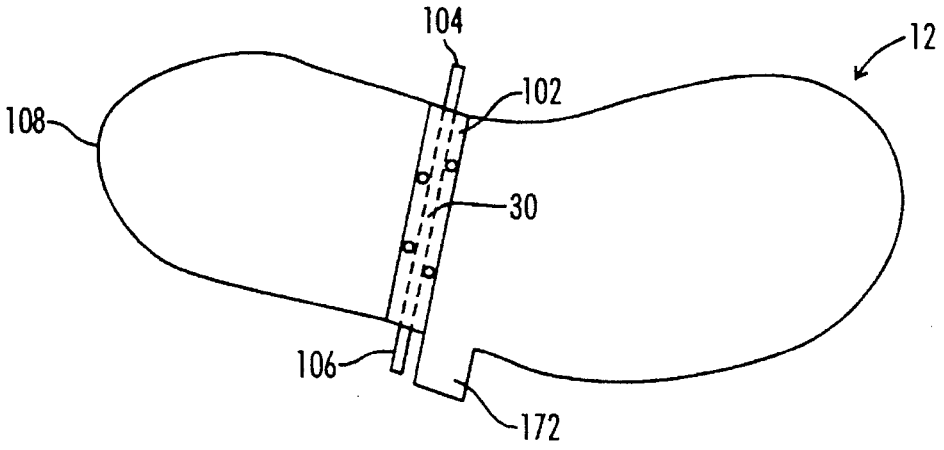
FIG. 2 is a bottom view of a boot according to an embodiment of the invention.

FIG. 1 shows a binding 10 according to an embodiment of the invention and FIG. 2 shows a boot sole 12 configured to engage the binding in FIG. 1. The apparatus composed of the binding 10 and boot sole 12 is suitable for various snowsport activities which require securing one's footwear to a piece of sports equipment. In particular, the apparatus is suitable for securing a snowboard boot to a snowboard.

Figure 3:
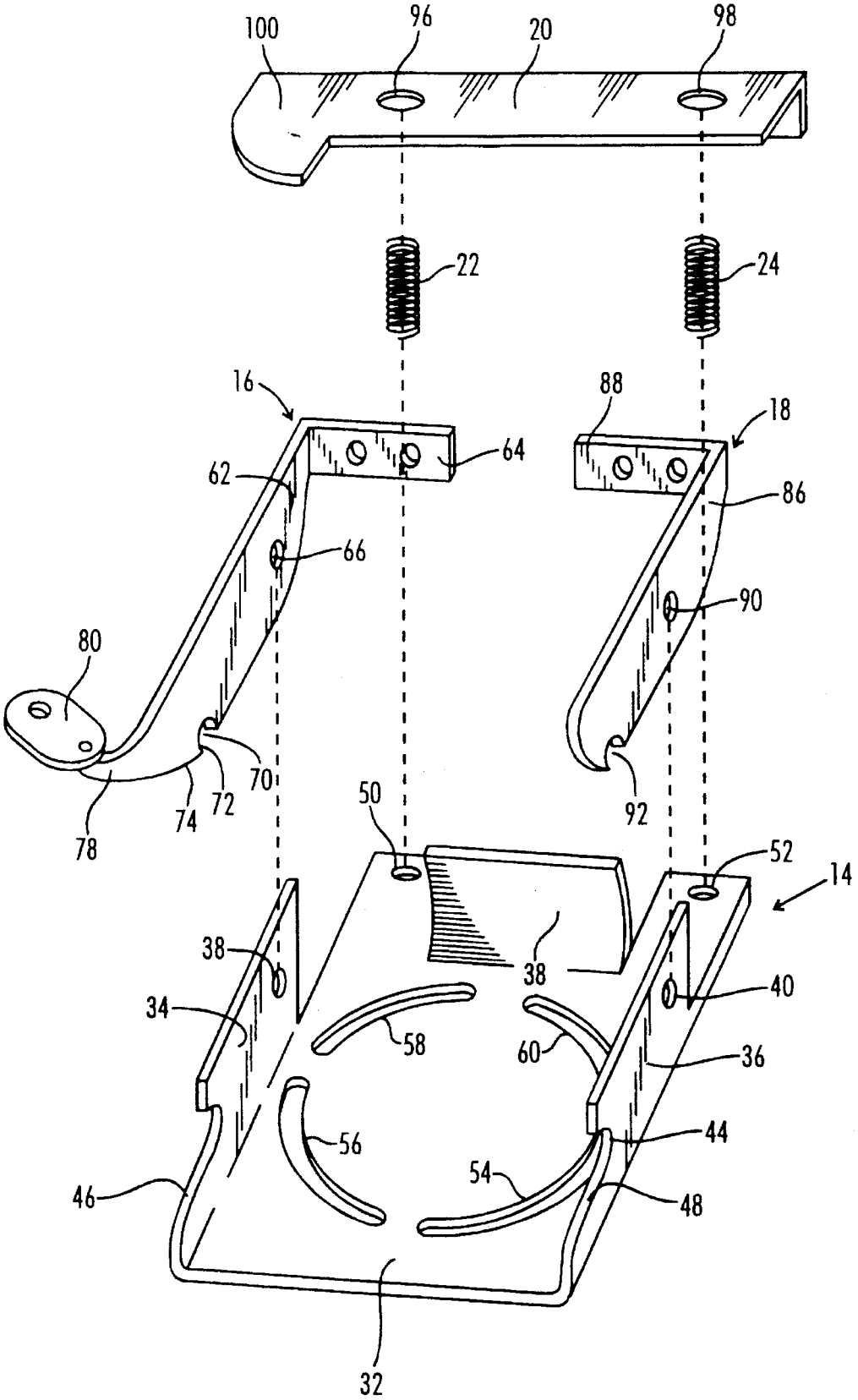
FIG. 3 is an exploded view of the binding of FIG. 1.

An exploded view of the binding 10 is shown in FIG. 3. The structure and function of the binding 10 is discussed below with reference to FIGS. 1–3.

The binding 10 shown in FIGS. 1 and 3 is generally composed of a base 14, first and second movable arms 16 and 18, a backing member 20 connecting the first and second arms 16 and 18 together and a pair of coil springs 22 and 24 extending between the base 14 and the backing member 20. As discussed in further detail below, the first and second arms 16 and 18 are pivotally connected to the base 14 to selectively open and close two pin receptacles 26 and 28. When opened, the pin receptacles are capable of receiving or releasing a pin 30 secured to the boot sole 12. When closed, the pin receptacles are capable of retaining the pin 30 and, thereby, securing the boot sole 12 to the binding 10.

The base 14 includes a generally rectangular bottom plate 32, first and second side members 34 and 36 and a heel stop 39. In the illustrated embodiment, the above-noted components of the base 14 are formed as a unitary structure, e.g., from a single sheet of material (such as metal) which is cut and bent to the configuration shown in FIG. 3. However, it will be readily recognized that the base 14 may be formed by suitable molding processes from a metal, plastic or other resin-type material. Alternatively, the base 14 may be formed by several individual parts, connected together.

The side members 34 and 36 extend upward from the bottom plate 32 at opposite sides of the bottom plate 32. Each side member 34 and 36 has an aperture 38 and 40, respectively, for receiving a pivot link, such as a rotatable rivet. Each side member 34 and 36 also has a rounded indentation 42 or 44, respectively, which, as discussed further below, defines a portion of the pin receptacle 26 or 28, respectively. In the illustrated embodiment, the side members 34 and 36 are formed by folding upward portions of the sheet of material from which the bottom plate is made. A further portion of this sheet of material is folded upward in front of the side member 34 to form a sloping ramp 46 for helping to guide the pin 30 into the pin receptacles 26 and 28.

The heel stop 39 extends upward from the bottom plate 32 and forms a stop for preventing the heel of the user's boot from moving downward and the toe of the boot from lifting once the boot sole 12 is inserted into the binding 10. In the illustrated embodiment, the heel stop 39 is formed by folding upward a portion of the sheet of material from which the bottom plate is made.

The bottom plate 32 is provided with two rear apertures 50 and 52 for receiving spring connectors, such as rivets, for connecting one end of each spring 22 and 24 to the plate 32. The bottom plate 32 also has four curved, elongated apertures 54, 56, 58 and 60, for receiving connectors (not shown), such as rivets, screws, bolts or the like, for connecting the plate 32 to a piece of sports equipment (not shown), such as to the top surface of a snowboard.

The first movable arm 16 comprises a generally "L" shaped member having a long extension 62 and a substantially perpendicular short extension 64. The long extension 62 has an aperture 66 for receiving the pivot link received by aperture 38 of side member 34, so as to pivotally connect arm 16 to base 14. In the illustrated embodiment, the pivot link connecting arm 16 to the side member 34 of base 14 comprises a pivotal rivet 68. However, it will be understood that other suitable connectors for pivotally connecting arm 16 to base 14 may be employed.

The long extension 62 of arm 16 is provided with an indentation 70 which cooperates with the rounded indentation 42 of the side member 34 to form the first pin receptacle 26, as best shown in FIG. 1. One edge 72 of the indentation 70 forms a stop surface or pin receptacle closing edge which is capable of inhibiting the pin 30 from exiting the pin receptacle 26, once the pin 30 has been received within the receptacle 26. In the illustrated embodiment, edge 72 defines a relatively straight surface. The long extension 62 has a sloped surface 74 extending from the edge 72. The sloped surface 74 is adapted to abut the pin 30 as the user's boot is moved into the binding 10, so as to cause the arm 16 to pivot in the direction of arrow 76 with the movement of the boot toward the interior of the binding.

The free end of the long extension 62 is curved slightly away from the center of the base 14 so as to define a curved surface 78. The curved surface 78 can help guide the heel of the user's boot into the binding 10. A handle 80 is attached to the free end of the long extension 62 and provides a mechanism by which a user can readily pivot the arm 16 in the direction of arrow 76 by moving the handle 80 in the direction of arrow 82. The handle 80 can be moved by gripping the handle and lifting it relative to the bottom plate 32.

Typically, snowboards are provided with a leash connected to the binding to reduce the occurrence of runaway boards. In the illustrated embodiment, the leash 84 may be secured to the handle 80 so as to not only inhibit board runaway, but also to allow the user to move the handle in the direction of arrow 82 by simply pulling upward on the leash. Preferably, the leash is made of a flexible rope, cloth, rubber or rubber-like material which is long enough to extend upward along a user's leg and be secured to the user's pant leg at a location convenient for the user to reach.

The second movable arm 18 comprises a generally "U" shaped member having a long extension 86 and a substantially perpendicular short extension 88. The long extension 86 has an aperture 90 for receiving the pivot link received by aperture 40 of side member 36, so as to pivotally connect arm 18 to base 14 in a manner similar to the manner in which arm 16 is pivotally connected to base 14. The long extension 86 of arm 18 is also provided with an indentation 92 which cooperates with the rounded indentation 44 of the side member 36 to form the second pin receptacle 28, as best shown in FIG. 1.

In an alternate embodiment, the first and second movable arms may be formed as a unitary, generally "U" shaped structure, rather than the oppositely facing, generally "L" shaped structures shown in FIG. 3. The arms 16 and 18 may be formed of any suitable material, such as metal, plastic or other resin material by any suitable manufacturing process, such as stamp processes, molding processes, extrusion process, or the like.

The backing member 20 is provided to rigidly secure the first and second movable arms 16 and 18 together and to connect to the ends of the springs 22 and 24 opposite to the spring ends connected to the bottom plate 32. In the illustrated embodiment, the backing member 20 is formed as a separate element connected to arms 16 and 18. In alternative embodiments, the backing member 20 may be formed as a unitary structure with one or both arms 16 and 18. The combination of the arms 16 and 18 and the backing member 20 form a pivotal arm mechanism, pivotally connected to the base 14.

In the illustrated embodiment, the backing member 20 is rigidly connected to the short extensions 64 and 88 of each of the movable arms 16 and 18, respectively. Apertures 96 and 98 are provided in the backing plate 32 for receiving spring connectors, such as a rivets, for connecting one end of each spring 22 and 24 to the backing member. The springs 22 and 24 bias the backing member 20 away from the bottom plate 32 which biases the arms into a position wherein the pin receptacles 26 and 28 are closed.

The backing member 20 has an extension 100 which extends laterally outward on the first movable arm 16 side of the binding 10. The extension 100 provides a convenient surface on which a user may press to move the backing member in the direction of arrow 102 and to, thereby, pivot the movable arms 16 and 18 about their respective pivotal connections, against the bias of the springs 22 and 24. This causes the forward ends of the movable arms 16 and 18 to move in the direction of arrows 76 and 96, respectively, for selectively opening the pin receptacles 26 and 28. In this manner, a user may release a boot from the binding 10 by pressing down on extension 100 with the user's other boot (not shown), hand (not shown) or ski pole tip (not shown).

As discussed above, the user may use the handle 80, the leash 84 or the extension 100 for moving the arms 16 and 18 against the bias of the springs 22 and 24 to selectively release a boot from the binding 10. Once the user releases the extension 100, handle 80 or leash 84, the springs 22 and 24 automatically bias the arms 16 and 18 into the position in which the pin receptacles 26 and 28 are closed.

In the embodiment shown in FIG. 2, the pin 30 is secured to the boot sole by a securing plate 102. Plate 102 is rivetted to the sole 12 over the pin 30. However, it will be readily understood that other suitable means by which the pin 30 can secure to the boot may be employed. For example, the pin 30 may be molded into the boot or boot sole or may be inserted into an aperture extending through the width of the boot sole. In addition, while the pin 30 shown in FIG. 2 comprises a single length of a generally cylindrical member, other embodiments may employ a pin defined by two separate or interconnected members extending from either side of the boot sole. In one embodiment the pin and plate 102 are formed as a unitary structure mounted to the boot sole.

The pin 30 defines two pin ends 104 and 106 which extend laterally outward from the boot sole 12. To secure the boot sole 12 to the binding 10, the heel 108 of the boot is moved into the interior of the binding in the direction of arrow 110. As the boot is so moved, the pin end 104 is guided by the ramps 46 toward the sloped surface 74 of the arm 16.

Upon engaging the sloped surface 74, further movement of the boot causes the pin end 104 to move the arms 16 and 18, against the bias of springs 22 and 24, in the direction of arrows 76 and 96, respectively, so as to open the pin receptacles 26 and 28. Further movement of the boot heel 108 in the direction of arrow 110 causes the pin ends 104 and 106 to enter the pin receptacles 26 and 28, whereupon the arms will be biased by springs 22 and 24 into the position in which the pin receptacles are closed. In this manner, the pin ends 104 and 106 will be locked into the receptacles 26 and 28, respectively, and the boot sole 12 will, thereby, be secured to the binding 10. Selective release of the pin ends 104 and 106 from the receptacles 26 and 28 can be accomplished, as discussed above, with the handle 80, leash 84 or extension 100.

The cooperation of the curved surface 78, ramps 46 and 48, wide front opening of binding 10 and the curved back heel surface of most boots allows the user to easily move the boot into the proper engagement position in the binding. In this manner, the user may merely kick the boot heel backwards into the binding 10 (in the direction of arrow 110) to effect an automatic alignment and engagement of the pin ends 104 and 106 with the pin receptacles 26 and 28.

In a further embodiment, the edge 72 of arm 16 and the corresponding edge of arm 18 may be provided with a slight curve or slope and the portion of the pin ends 104 and 106 which abut these edges may be correspondingly shaped so as to cause the pin ends to pivot the arms 16 and 18 from inside of the pin receptacles 26 and 28, if the boot were subjected to a sufficiently great twisting or lifting force (twisting the boot with respect to the binding 10). This would provide a safety release mechanism, by which the user's boot would be released from the binding 10, once the boot was subjected to a sufficiently great twisting or lifting force.

In the embodiment shown in FIG. 2, the pin 30 is mounted to the boot sole 12, toward the rear of the center of the boot length, but substantially spaced from the boot heel 108 toward the boot center. Further embodiments of the binding 10 may be dimensioned such that the pin 30 may be mounted closer to the boot heel or closer to the boot toe. However, the location of the pin 30 towards the center of the boot length provides significant benefits in certain snowsport activities, such as snowboarding. With the pin 30 so located the boot heel and toe ends play little or no part in the securement of the boot to the binding and, therefore, may be curved upwards (into the page in FIG. 2). With the boot heel and toe ends curved upwards, the snowboard user is less likely to catch the boot heel or toe in the snow, such as during sharp turns or stops. This is especially important to snowboarder's whose boots are longer than the width of the snowboard (which is the case with most adult male snowboard users).

In addition, it is believed that much of the control force exerted by a snowboarder is transferred through the center portion of the snowboarder's foot. Thus, the connection of the boot sole to the binding near the center of the boot effects a more efficient transfer of the snowboarder's control force to the snowboard, through the binding. This should translate to a high performance snowboard binding.

The ability to transfer control forces to the snowboard, as well as the ability to maintain ones balance, is often limited or restricted by the stiffness of conventional snowboard boot and binding structures. This is not only characteristic of snowboarding, but is also true with conventional boots for other snowsports, such as snow skiing. Modern ski boots are typically made of a hard resin material and are designed to maintain the user's ankle relatively stiff for safety purposes. However, this stiff ankle approach presents a number of problems, including making it difficult to bend one's knees without uncomfortably jamming one's shins into the front of the boot interior. In addition, anyone who has ever put on a pair of modern stiff ski boots would likely agree that such boots make it difficult and very uncomfortable to walk.

While some snowboard boots are designed with a relatively high degree of flexibility, such boots are designed to fit within a stiff, shin-high binding structure fixed to the snowboard. In this regard, once the user's boots are secured to the snowboard binding, very little flexibility is allowed. Moreover, such flexible snowboard boots are typically provided with laces for securing the boot to the user's foot. These laces tend to be difficult and very time consuming to use, especially if the user's fingers are cold and stiff. In addition to the laces, the snowboard user must also manipulate a number of straps and buckles by hand to secure the boot to the binding. This tends to be rather frustrating, especially since the snowboarder must disengage at least one boot from the snowboard binding each time the snowboarder gets in a lift line so that one boot is free to push the board, in a skateboard style action.

Of course, with the binding and boot structure discussed above with respect to FIGS. 1–3, the snowboarder can rather easily disengage boot from the binding 10 by merely lifting the handle 80, pulling the leash 84 or pushing the extension 100 and sliding the boot out of the binding. In addition, the snowboarder can rather easily engage the boot with the binding 10 by merely kicking the boot heel back into the binding. However, ready engagement and disengagement of the boot from the binding is not the only concern among snowboarders and other snowsports participants. As discussed above, there is also the concern of restricted ankle movement and the concerns of using laced boots.

Therefore, a snowsport boot according to an embodiment of the invention is designed to selectively allow ankle movements for better control during the sporting activities and/or for allowing the ankle to move in a much more normal fashion for walking. Moreover, this snowsport boot may be designed with the easy to use clip-type closures characteristic of conventional rear entry ski boots, rather than the much more inconvenient laces.

Figure 4:
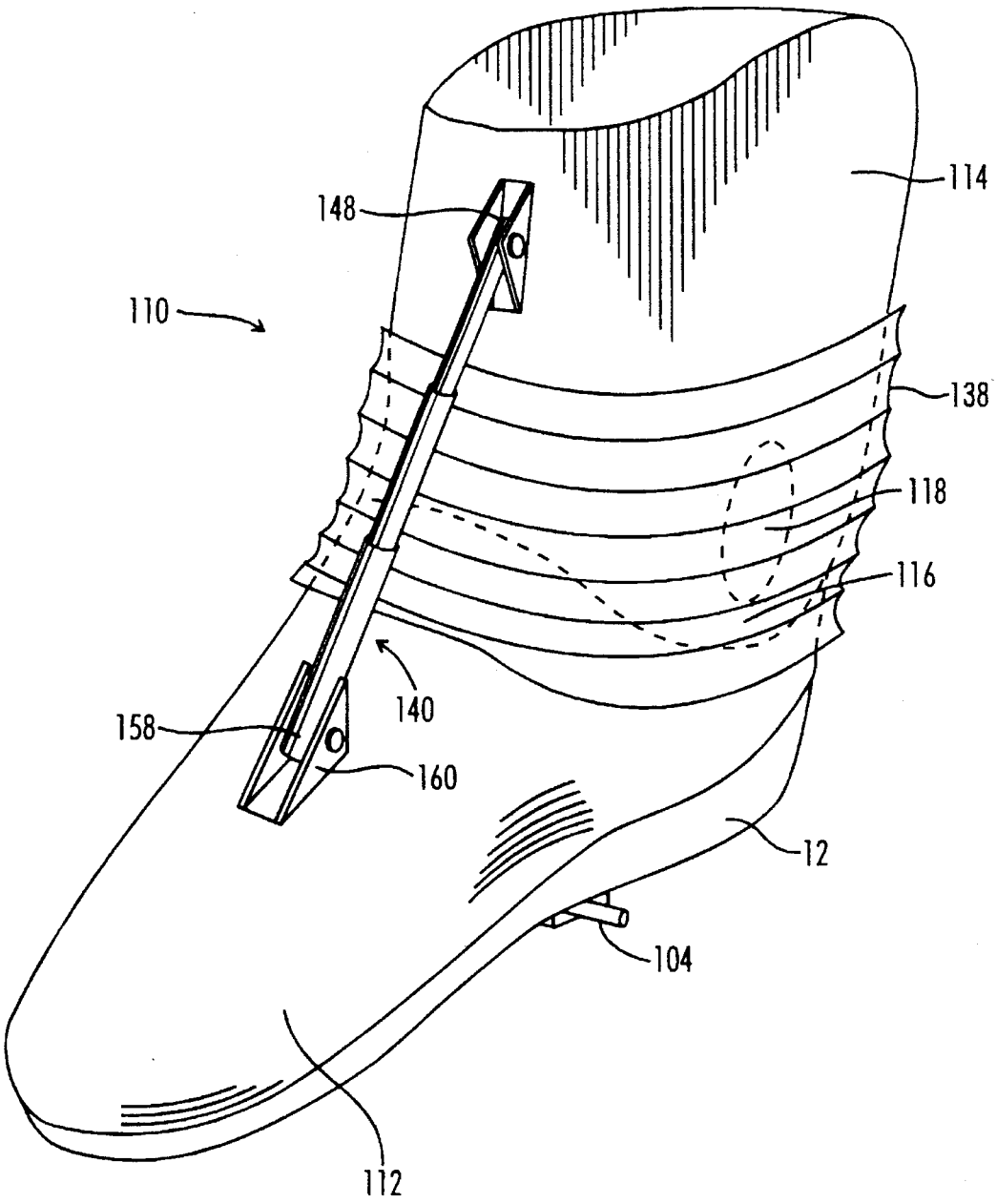
FIG. 4 is a perspective view of a boot according to an embodiment of the invention.

FIG. 4 shows a snowsport boot 110 according to an embodiment of the invention. The boot 110 is provided with the sole 12 and pin 30 discussed above, for use with the binding 10 discussed above. The boot has a lower casing 112, for encasing the user's foot and ankle (not shown), and a cuff or upper casing 114, for encasing the user's shin and lower leg (not shown). The upper casing 114 has a hinge holding extension 116 which extends downward over a portion of the lower casing. Preferably, the upper and lower casings 112 and 114 are made of the same type of hard resin material used in many modern conventional ski boots.

The upper and lower casings 112 and 114 are pivotally secured to each other by a pair of hollow hinges 118 (only one hinge is in view in broken lines in FIG. 4). The hollow hinges 118 are located such that the axis of rotation of each hinge is co-axial with the axis of rotation of the user's ankle, when the boot is worn by the user. This requires the hinges 118 to be located adjacent the outward protruding ankle bones of the wearer. Unlike certain conventional boots having a hinge-type connection located below and behind the ankle, the hollow hinges 118 allow a relatively high degree of ankle movement. The location of the hinges 118 co-axial with the ankle's axis of rotation, therefore, provides significant benefits over such conventional boots, in that the boot 110 is much less limiting and restrictive of ankle movements. This allows the wearer's knees to bend without causing the wearer's shins to uncomfortably jam against the front interior of the boot and allows the user to walk in a much more normal fashion.

Figure 5:
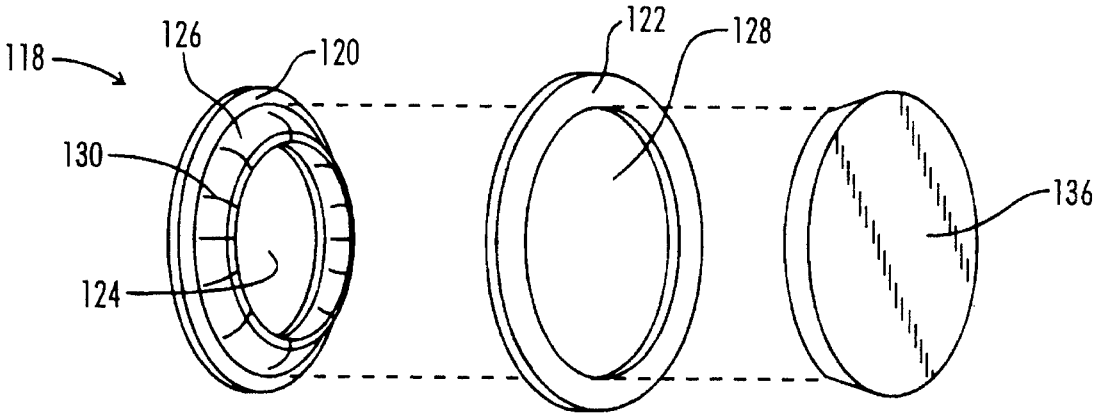
FIG. 5 is an exploded view of a hollow hinge as used in the boot of FIG. 4.
Figure 6:
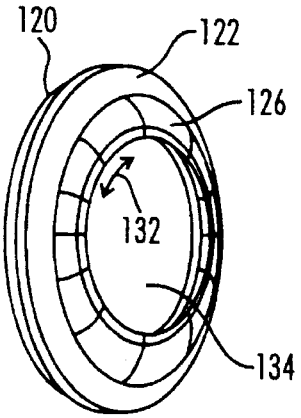
FIG. 6 is a perspective view of a hollow hinge of FIG. 5.

The hinge structure, best shown in FIGS. 5 and 6, is composed of two main pieces, a flaring piece 120 and a receiving piece 122. One or both pieces 120 and 122 may be formed separately from or, alternatively, formed unitarily with the casings 112 and 114, such that one of the pieces 120 or 122 is fixed with casing 112 and the other piece 120 or 122 is fixed with the hinge holding extension 116 of casing 114. In the illustrated embodiment, the flaring piece 120 is formed as a separate member fixed with the lower casing 112 and the receiving piece is formed as a separate member fixed with the hinge holding extension 116 of the upper casing 114.

The flaring piece 120 comprises a circular ring defining a circular opening 124 and a flarable portion 126. The receiving piece 122 comprises a circular ring or a plate defining a circular opening 128. The receiving piece 122 in FIG. 5 is in the form of a circular ring. The flarable portion 126 of piece 120 is configured to fit through the circular opening 128 of piece 122 and to be flared outward and over a portion of the receiving piece 122, so as to rotatably connect the pieces 120 and 122 together as shown in FIG. 6. Slits 130 may be formed in the flarable portion 126 to make the flaring process easier. However, certain relatively pliable materials, such as brass, may allow ready flaring without the need to form slits 130 in the flarable portion 126. Other process of making hollow hinge structures will be readily apparent to those skilled in the art, once taught to use such hollow hinges by the present disclosure.

Once connected together, as discussed above, the flarable piece 126 is rotatable relative to the receiving piece, in the directions of the double arrow 132. In addition, the circular openings 124 and 128 of the two pieces form a hollow interior 134 of the hinge structure and, hence, a hollow hinge. The hollow interior 134 of the hollow hinge structure provides at least two major benefits. First, it provides a large opening for the wearer's protruding ankle bones, such that the boot casings 112 and 114 and the hollow hinge 118 may closely conform to the shape of the user's foot and ankle. Second, it distributes stress about a relatively large surface area, defined by the area of overlap between the flarable portion 126 and the receiving piece 122.

The use of the hollow hinges 118 allows the axis of rotation of the upper casing 114 relative to the lower casing 112 to be located coaxially with the ankle, without significantly increasing the width of the boot at the ankle. This is very important in certain snowsports, such as snow skiing. In particular, experienced skiers tend to maintain their skis and boots very close together and repeatedly slide their skis (and boots) next to each other causing their boots to repeatedly pass each other as closely as possible. Since the hollow hinges 118 do not significantly increase the boot width, the skier will be able to slide one boot past the other while the skis remain very close and parallel to each other.

Since the hollow hinges 118 distribute stress over a relatively large surface area, the hinges may be designed with a light, relatively thin material without compromising the strength needed to maintain the connection between the lower and upper casings 112 and 114. In addition, this distribution of stress over a relatively large area may obviate a need to provide reinforcement in the boot structure around the hinge area. The hinges 118 may be made of any suitable material, such as stainless steel, brass, or other metals. A resin material, preferably a self lubricating resin, may alternatively be used. The hinge pieces 120 and 122 may be made of dissimilar materials so as to aid in their ability to provide relative movement therebetween. In addition, the upper and lower boot casings 14 and 12 may be made of dissimilar materials to aid in their ability to move with respect to each other while in contact with each other.

In preferred embodiments, a soft rubber or rubber-like plug 136 is provided to cover the hollow interior 134 so as to inhibit snow and water from entering the boot through the hollow interior 134. In addition, a rubber or rubber-like flexible bellows structure 138 is mounted over the hollow hinge 118 and the lower edge of the upper casing 114. In a preferred embodiment, the plug 136 and bellows structure 138 may be formed as a unitary structure, e.g. in a single molding step.

With the above discussed boot structure, the degree of free ankle movement may he quite satisfactory for allowing the wearer to comfortably walk about while wearing the boot. However, the degree of free ankle movement may be unsatisfactory for certain snowsport activities, such as snow skiing or snow boarding. Accordingly, the boot shown in FIG. 4 may be provided with a device for selectively restricting the degree of ankle movement otherwise allowed by the boot. An embodiment of such an ankle movement restriction device or damping means is shown in FIGS. 4 and 7 with reference number 140.

Figure 7:
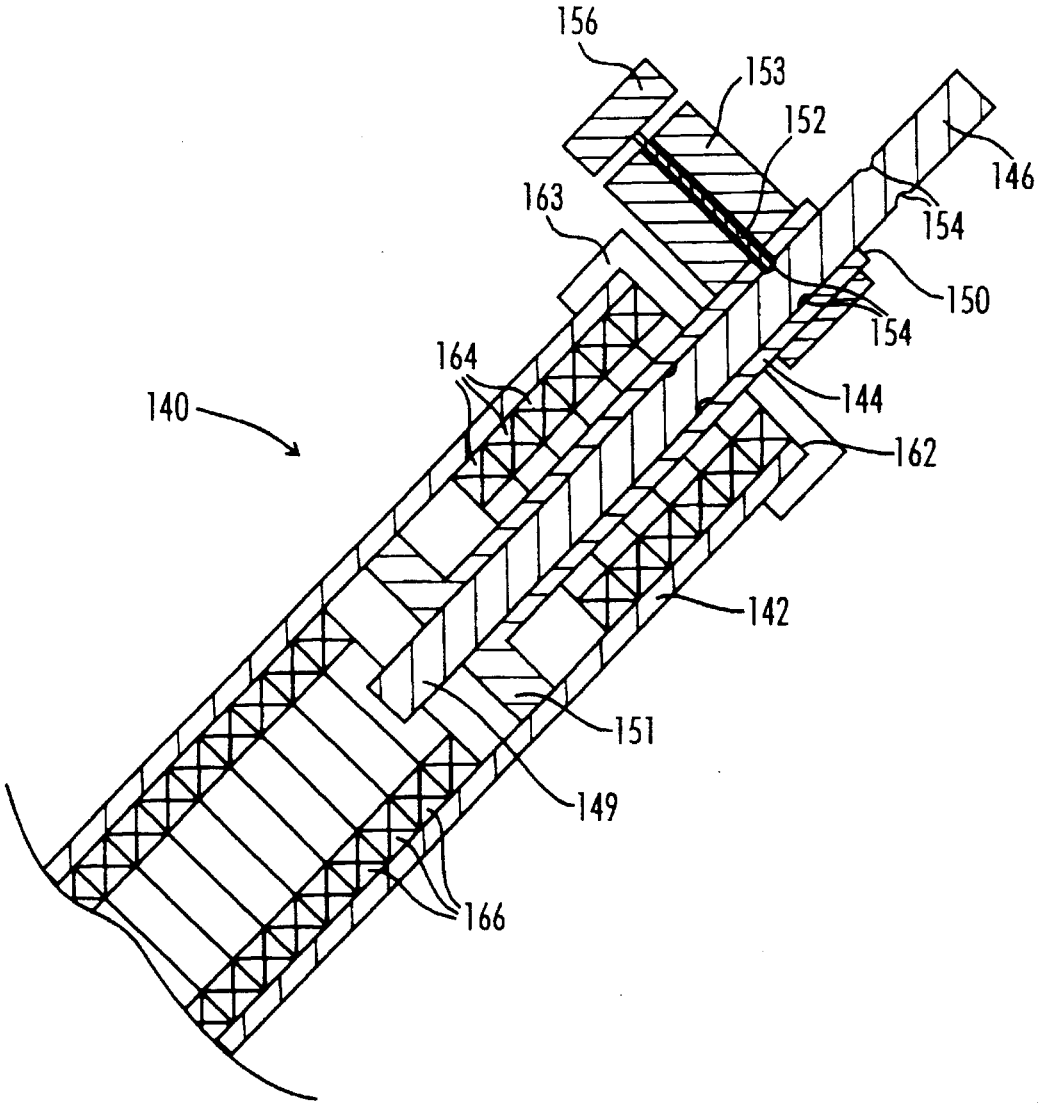
FIG. 7 is a partial side view of an ankle movement restricting device as used on the boot of FIG. 4.

The device 140 comprises a set of three cylindrical members 142, 144 and 146 of differing cross-section diameters, arranged in a telescoping manner, as shown in FIGS. 4 and 7. The smallest diameter member 146 is a solid cylindrical rod having one end pivotally connected to the upper casing 114 by a suitable pivotal bracket 148 and an opposite free end 149. The next smallest diameter member 144 comprises a first hollow tube having a first end 150 and a second end 151. The first end 150 of tube 144 is open and receives therein the free end 149 of rod 146.

A movable pin 152 extends through the side wall of tube 144 and is adapted to selectively engage any one of a number of indentations or apertures 154 provided along the length of rod 146. A handle 156 connected to pin 152 allows a user to selectively move the pin 152 into or out of engagement with the apertures 154. This may be accomplished in a number of ways. For example, pin 152 may be spring biased by a spring structure (not shown) toward rod 146, wherein the spring bias may be overcome by pulling the handle 156 radially outward of tube 144. The handle may be provided with a mechanism (not shown) wherein the handle 156 may be turned in order to lock the pin in its disengaged state. Such spring loaded pin and handle arrangements are well known. Alternatively, the pin 152 may be threaded and extended through a correspondingly threaded hole in tube 144, or through a threaded hole in an extension 153 such that the handle 156 may be turned in order to thread the pin further into (or out of) the tube 144 and eventually into (or out of) an aperture 154 of rod 146.

When the pin 152 is engaged with an aperture 154, the rod 146 will be restricted from movement with respect to tube 144. On the other hand, when the pin 152 is disengaged with the apertures 154, the rod 146 will be freely slidable within tube 144. In this freely slidable state of rod 146, the hollow hinges 118 will be allowed to freely rotate. In this manner, a great degree of ankle movement will be allowed, such that the boot wearer may comfortably walk or stretch.

By bending the ankle to a desired position and engaging the pin 152 with an aperture 154 at that position, the boot wearer may set the boot at the particular ankle position which is most suitable for the particular sports activity in which the boot wearer is engaging. For instance, if the wearer desires to have the ankle angle such that the wearer's legs are leaned forward with the knees bent in a racing position, the wearer may engage the pin 152 with an aperture 154 while the rod 146 is slid relatively far into the tube 144. On the other hand, if the wearer desires to have the ankle angle maintained at a position consistent with a traditional ski boot, the wearer may engage the pin 152 with an aperture 154 while the rod 146 is extended further outside of the tube 144 than in the above racing position. Thus, the sliding rod and tube structure 146 and 144 and the pin 152 allow a user to preset the ankle angle.

The largest diameter cylindrical member 142 comprises a second hollow tube having a first end 158 pivotally connected to the lower boot casing 112 by a suitable pivotal connector 160. The second end 162 of tube 142 receives therein the second end 152 of tube 144. The second tube end 162 may be provided with a cap 163 for retaining the below described bushing members 164 within the tube 142. The second end 152 of tube 144 defines a piston head which is movable within the tube 142 insofar as such movement is allowed by bushing members 164 and 166.

Bushing members 164 and 166 may be, for example, resilient rubber or rubber-like tubes or rings. Bushing members 164 are provided around a portion of the tube 144 within tube 142 and allow limited outward sliding movement of the tube 144 relative to tube 142. Bushing members 166 are positioned below the piston head end 152 of tube 144, within tube 142, and allow limited inward sliding movement of the tube 144 within tube 142. The interaction of the tubes 142 and 144 and the bushing members 164 and 166, in cooperation with the boot hinges 118, provides the user with a limited degree of ankle movement during a snowsports activity. This limited ankle movement can allow the user to more comfortably lean forward by reducing the force of the shin against the front of the boot interior. In addition, this limited ankle movement can allow the user to more comfortably absorb bumps and shocks and can provide the experienced skier or snowboarder with the ability to lean the legs further forward and bend the knees to a greater degree during periods in the snowsport activity.

The degree of freedom of movement of the tube 144 in the direction out of tube 142 is determined by the hardness of the bushing members 164. The degree of freedom of movement of the tube 144 in the direction further into tube 142 is determined by the hardness of the bushing members 166. These degrees of freedom of movement can, therefore, be set by selecting the hardnesses of bushing members 164 and 166. In preferred embodiments of the invention, the user is provided with a selection of bushing members of differing hardnesses and can select the bushings (and bushing hardnesses) for inserting into the tube 142.

In the illustrated embodiment, the sets of bushing members 164 and 166 are spaced from each other by a distance greater than the width of the piston head end 152 of tube 144. In this regard, tube 144 is allowed to move with respect to tube 142, by a limited amount, without engaging and compressing the bushing members 164 and 166, allowing the boot wearer a limited amount of free ankle movement. This may be a desirable feature, especially for beginners, in that the limited free ankle movement will reduce stress of the wearer's shins against the interior of the boot front as the wearer leans forward. In further embodiments, the space between the piston head end 152 and the bushing members may be eliminated by adding further bushing members.

If a large number of hard bushings are fitted above the piston head end 152 the ankle is locked with the knee forward in the extreme racers position. Using softer bushings below the piston head end 152 would gently cushion the forward movement of the lower leg, to give beginners a feel for getting the knee forward, and it would certainly reduce, and possibly eliminate (if the right hardness and quantity of rubber washers were correctly selected by the dealer) the very common complaint of sore shins, which are due to pressure from the top of the boot cuff.

For the beginner, shorter or less bushings above the piston head end 152 allows a more upright stance, and softer bushings may be used below the piston head end. The more experienced, stronger skier would fit longer or more bushings above the piston head end 152 and shorter or fewer bushings below the piston head end for greater forward lean of the legs.

In a further embodiment, the boot is designed to allow a degree of lateral leg movement. According to this embodiment, the opening 128 of the receiving piece 122 of the hollow hinge is elongated such that the flaring piece 120 may not only be rotatable with respect to the receiving piece 122, but may also be slidable therein to a limited extent. In addition, the boot sole 12 is provided with an extension 172 for mounting the lower pivotal connector 160 of a second telescoping tube device (not shown) similar to the above discussed device 140. The upper pivotal connector 148 of the second telescoping tube device is connected to the outer side of the upper casing 114, i.e., the side opposite to the side facing the users other boot. The second telescoping tube device operates to selectively restrict the allowed lateral leg movement in a manner similar to the manner in which the device 140 discussed above selectively restricts the amount of allowed ankle movement.

While the above described hollow hinge structure and ankle angle setting device 140 are illustrated in FIG. 4 in conjunction with a boot having a pin 30 for use with the above described binding 10, it will be readily recognized that the hollow hinge and ankle angle setting boot structure may be employed in conjunction with boots used with other types of bindings.

What is claimed is:

1. A binding for use with a snowsport boot having two pin ends extending therefrom and a piece of snowsport equipment, each pin end defining a circumference, the binding comprising:

a base adapted to be fixed to the piece of snowsport equipment, the base having a pair of side members, each side member having a first edge defining an indentation configured to receive at least a portion of one of the pin ends, each side member having a side member portion extending above the indentation for restricting upward movement of the pin ends upon the pin ends being received within the indentations;

a pivotal arm mechanism pivotally mounted to the base for pivotal movement between a first position and a second position relative to the base, the pivotal arm mechanism having a second edge associated with each side member and cooperating with the indentation in the associated side member to define a closed pin receptacle upon the arm mechanism being in the first position relative to the base and an open pin receptacle upon the arm mechanism being in the second position relative to the base, the pin receptacles being adapted to receive the pin ends extending from the boot; and at least one spring coupled to the pivotal arm mechanism for biasing the pivotal arm mechanism toward the first position relative to the base; wherein upon the pivotal arm being in the first position the second edge is disposed adjacent the first edge of the indentation in the associated side member such that the combination of the adjacent first and second edges forms a pin receptacle having a substantially closed loop shape to substantially surround the circumference of a pin end when received in the pin receptacle.

2. A binding as recited in claim 1, wherein the base further comprises a ramp arranged adjacent the indentation in each side member for guiding the pin ends into the indentations.

3. A binding as recited in claim 1, further comprising a handle coupled to the pivotal arm mechanism for moving the pivotal arm mechanism between its first and second positions relative to the base.

4. A binding as recited in claim 3, further comprising a leash coupled to the handle for allowing a remote operation of the handle.

5. A binding as recited in claim 1, wherein:

the pivotal arm mechanism comprises a pair of pivotal links connected to the base;

the at least one spring is coupled to the pivotal arm mechanism on one side of the pivotal links and the pin receptacles are located on the opposite side of the pivotal links.

6. A binding as recited in claim 5, further comprising a pull handle coupled to the pivotal arm mechanism on the pin receptacle side of the pivotal links, for allowing the arm mechanism to be moved from its first position to its second position by pulling the pull handle.

7. A binding as recited in claim 6, further comprising a leash coupled to the pull handle for allowing the pull handle to be pulled from a remote location.

8. A binding as recited in claim 5, further comprising a push surface provided on the pivotal arm mechanism, on the spring side of the pivotal links, for allowing the arm mechanism to be moved from its first position to its second position by pushing the push surface.

9. A binding for use with a snowsport boot having two pin ends extending therefrom and a piece of snowsport equipment, the binding comprising:

a base adapted to be fixed to the piece of snowsport equipment, the base having a pair of side members, each side member defining an indentation configured to receive at least a portion of one of the pin ends, each side member having a side member portion extending above the indentation for restricting upward movement of the pin ends upon the pin ends being received within the indentations;

a pivotal arm mechanism pivotally mounted to the base for pivotal movement between a first position and a second position relative to the base, the pivotal arm mechanism cooperating with the base to define a closed pin receptacle upon the arm mechanism being in the first position relative to the base and an open pin receptacle upon the arm mechanism being in the second position relative to the base, the pin receptacles being adapted to receive the pin ends extending from the boot; and at least one spring coupled to the pivotal arm mechanism for biasing the pivotal arm mechanism toward the first position relative to the base;

wherein the pivotal arm mechanism comprises a pair of arm extensions, a pivotal link located along the length of each arm extension for pivotally connecting the arm extensions to the base and a backing member rigidly coupling the arm extensions; and wherein the at least one spring comprises at least one coil spring having a first end coupled to the base and a second end coupled to the backing member.

* * * * *